US006537955B1

(12) United States Patent
Raso et al.

(10) Patent No.: US 6,537,955 B1
(45) Date of Patent: Mar. 25, 2003

(54) CLEANING AND DISINFECTING COMPOSITIONS COMPRISING $C_6$- $C_7$ ALKYL SULFATE

(75) Inventors: Floriana Raso, Rome (IT); Marina Trani, London (GB); Antonella Severini, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/529,576

(22) PCT Filed: Oct. 12, 1998

(86) PCT No.: PCT/IB98/01583

§ 371 (c)(1),
(2), (4) Date: Apr. 14, 2000

(87) PCT Pub. No.: WO99/19441

PCT Pub. Date: Apr. 22, 1999

(30) Foreign Application Priority Data

Oct. 14, 1997 (EP) ..... 97870155

(51) Int. Cl.[7] ..... C11D 17/00

(52) U.S. Cl. ..... 510/218; 510/424; 510/426; 510/438; 510/463; 510/499; 510/503

(58) Field of Search ..... 510/218, 424, 510/426, 499, 503, 463, 438

(56) References Cited

FOREIGN PATENT DOCUMENTS

| | | | |
|---|---|---|---|
| EP | 0 021 581 A1 | 1/1981 | ..... C11D/3/395 |
| WO | WO 92/02604 | 2/1992 | ..... C11D/1/83 |
| WO | WO 94/10272 | 5/1994 | ..... C11D/1/00 |
| WO | WO 95/03383 | 2/1995 | ..... C11D/1/75 |
| WO | WO 95/08611 | 3/1995 | ..... C11D/1/14 |
| WO | WO 97/25106 | 7/1997 | ..... A62D/3/00 |

*Primary Examiner*—Necholus Ogden
(74) *Attorney, Agent, or Firm*—Kevin L. Waugh; Jason J. Camp

(57) ABSTRACT

A cleaning and disinfecting composition which provides effective cleaning, disinfecting and shine performance, said composition comprising a surfactant system comprising from 0.01% to 10% by weight of the total composition of an amine oxide, from 0.01% to 20% by weight of a short chain alkyl sulphate surfactant according to the formula: $R_1SO_4M$, wherein $R_1$ represents a saturated or unsaturated alkyl group containing from 6 to 8 carbon atoms and M is H or a cation, and from 0.01% to 20% by weight of a long chain alkyl sulphate surfactant according to the formula: $R_2SO_4M$, wherein $R_2$ represents a saturated or unsaturated alkyl group containing from 9 to 30 carbon atoms and M is H or a cation. More preferably, the composition further comprises an anti-microbial compound and/or a peroxygen bleach for further enhanced disinfection performance.

34 Claims, No Drawings

CLEANING AND DISINFECTING COMPOSITIONS COMPRISING $C_6$- $C_7$ ALKYL SULFATE

TECHNICAL FIELD OF THE INVENTION

The present invention relates to a composition which provides a cleaning, disinfecting and shine performance on surfaces, especially hard surfaces.

BACKGROUND OF THE INVENTION

Efficient cleaning and disinfecting compositions are usually formulated based on surfactants that deliver the required cleaning and disinfecting properties to the surfaces treated therewith. Particularly suitable surfactants having such properties are for instance amine oxide surfactants. However, when formulating compositions with such surfactants it has been observed that they may left residues on the hard-surfaces treated therewith resulting in surfaces that do not appear shiny.

Indeed, the problem of providing shiny surfaces is often compromised by residues of the compositions which are left on said surfaces and which appear as streaks as water evaporation is completed. The problem of the residuality is even more noticeable where the composition is used to treat surfaces made of glossy materials, such as glossy ceramic tiles, windows and mirrors, or such materials as polyurethane-coated PVC which is widely used in Northern America. Furthermore, nowadays, many products are formulated or can be used as no-rinse products. In such conditions or with such products, the problem of residuality has become more acute.

Accordingly, there is a need for a composition which provides effective cleaning and disinfecting performance, but also provides the treated surfaces with a shiny effect without any residues.

Numerous solutions have been proposed in the art to solve this need, including the use of an acid, magnesium ions, or the use of certain solvents as described in WO 95/21229, EP 0 639 833 or U.S. Pat. No. 3,839,234.

The applicant has now surprisingly found that this need could also be met by formulating a composition which comprises a surfactant system comprising an amine oxide (0.01%–10%), a long chain alkyl sulphate (0.01%–20%) and a short chain alkyl sulphate (0.01%–20%). Indeed, it has been found that the addition of such a long chain alkyl sulphate, in a composition comprising an amine oxide and a short chain alkyl sulphate improves the shine properties delivered by said composition when used to treat a hard surface, this both when used in neat or diluted conditions.

This finding is especially surprising as the use of amine oxide surfactants alone and alkyl sulphate surfactants alone, which both provide effective cleaning and contribute to effective disinfecting, have been found to form crystals upon drying, which resulted in spotting residues on the treated surface. Surprisingly, the use of a mixture of an amine oxide as defined herein, a long chain alkyl sulphate and a short chain alkyl sulphate as defined herein, in a composition, especially a liquid composition, not only provides an effective cleaning and effective disinfecting of the hard-surfaces treated with this composition, but also causes said residues to appear less, or even not to appear anymore.

It is therefore an advantage of the invention to provide a composition which provides effective cleaning, disinfecting as well as shine performance on surfaces.

The applicant has further found that the addition of solvents to this surfactant system provides further enhanced cleaning and shine benefit.

In a preferred embodiment, the compositions herein further comprise a peroxygen bleach and/or an antimicrobial compound like antimicrobial essential oils or actives thereof. These ingredients provide enhanced disinfection performance on a hard-surface, even at high dilution levels, e.g., up to dilution levels of from 1:100 (composition:water).

It is thus another advantage of the invention to provide a composition with further improved disinfection performance.

It is yet another advantage of the invention to provide a composition which is mild to the skin.

SUMMARY OF THE INVENTION

The present invention relates to a cleaning and disinfecting composition comprising a surfactant system comprising:

- from 0.01% to 10% by weight of the total composition of an amine oxide,
- from 0.01% to 20% by weight of the total composition of a short chain alkyl sulphate surfactant according to the formula $R_1SO_4M$ wherein $R_1$ represents a saturated or unsaturated alkyl group containing from 6 to 8 carbon atoms and M is H or a cation
- and from 0.01% to 20% by weight of the total composition of a long chain alkyl sulphate surfactant according to the formula $R_2SO_4M$ wherein $R_2$ represents a saturated or unsaturated alkyl group containing from 9 to 30 carbon atoms and M is H or a cation.

In a preferred embodiment of the invention, the composition comprises a solvent for further enhanced cleaning and shine performance of the composition.

In another preferred embodiment of the invention, the composition further comprises a peroxygen bleach and/or an antimicrobial compound like an antimicrobial essential oil or actives thereof or mixtures thereof for providing the composition with further improved disinfecting performance.

The present invention also encompasses a process of treating a surface by applying on said surface a composition according to the present invention.

DETAILED DESCRIPTION OF THE INVENTION

Amine Oxide Surfactant

Amine oxides for use herein are compounds corresponding to the formula:

$$R\,R'R''N\rightarrow O$$

wherein R is a primary alkyl group containing 6–24 carbons, preferably 6–20 carbon atoms, more preferably 8–18 carbons, and wherein R' and R" are, each, independently selected from methyl, ethyl and 2-hydroxyethyl. The arrow in the formula is a conventional representation of a semi-polar bond.

The preferred amine oxides are those in which the primary alkyl group has a straight chain in at least most of the molecules, generally at least 70%, preferably at least 90% of the molecules, and the amine oxides which are especially preferred are those in which R contains 8–18 carbons and R' and R" are both methyl.

Exemplary of the preferred amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

These amine oxides surfactants are desired in the compositions of the present invention due to their cleaning properties and disinfecting properties. Indeed, they are particularly effective on greasy soap scum and/or kitchen dirt when a composition comprising them is used both in neat or diluted conditions. Also they contribute to the disinfecting properties of the compositions herein. The compositions of the present invention comprise from 0.01% to 10% by weight of the total composition of an amine oxide surfactant or a mixture thereof, preferably from 0.1% to 9%, more preferably from 0.5% to 5% and most preferably from 0.5% to 3%.

Short Chain Alkyl Sulphate Surfactant

Short chain alkyl sulphate surfactants for use herein are those according to the formula $R_1SO_4M$ wherein $R_1$ represents a saturated or unsaturated alkyl group containing from 6 to 8 carbon atoms, preferably from 7 to 8 carbon atoms. The alkyl group can be in straight or branched configuration, and preferably in straight configuration. M is H or a cation, e.g., an alkali metal cation (e.g., sodium, potassium, lithium, calcium, magnesium etc) or ammonium or substituted ammonium cations. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Suitable examples are sodium or potassium or ammonium octyl sulphate. For example sodium octyl sulphate is commercially available from ALLBRIGHT&WILLSON under the name EMPIMIN LV 330®.

Such short chain surfactants are desired herein as they contribute to the cleaning and disinfecting properties of the compositions herein. Advantageously, they also contribute to the low suds profile of the compositions herein.

The compositions of the present invention comprise from 0.01% to 20% by weight of the total composition of short chain alkyl sulphate surfactant or a mixture thereof, preferably from 0.1% to 10%, more preferably from 0.5% to 8% and most preferably from 1% to 6%.

Long Chain Alkyl Sulphate Surfactant

Long chain alkyl sulphate surfactants for use herein are those according to the formula $R_2SO_4M$ wherein $R_2$ represents a saturated or unsaturated alkyl group containing from 9 to 30 carbon atoms, preferably from 9 to 18 carbon atoms, more preferably from 9 to 14, even more preferably from 9 to 12 and most preferably 10. The alkyl group can be in straight or branched configuration, and preferably in straight configuration. M is H or a cation, e.g., an alkali metal cation (e.g., sodium, potassium, lithium, calcium, magnesium etc) or ammonium or substituted ammonium cations. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Suitable examples are sodium, potassium, ammonium nonyl sulphate, decyl sulphate, dodecyl sulphate and/or octyl decyl sulphate. For example, sodium decyl sulphate is commercially available from ALLBRIGHT & WILLSON under the name EMPICOL 0137®.

The compositions of the present invention comprise from 0.01% to 20% by weight of the total composition of a long chain alkyl sulphate surfactant or a mixture thereof, preferably from 0.05% to 10%, more preferably from 0.08% to 5% and most preferably from 0.1% to 3%.

It has now been observed that the addition of such a long chain alkyl sulphate in a composition (preferably liquid composition) comprising an amine oxide and a short chain alkyl sulphate leaves less residues on a hard-surface treated with this composition this both when applied in its neat form and diluted form, e.g. at a dilution level up to 500:1 (water:composition weight), as compared to the same composition without this long chain alkyl sulphate, while delivering effective cleaning and disinfecting performance to the surface treated.

Thus, in its broadest aspect the present invention encompasses the use of a C9–C30 alkyl sulphate in a composition, especially a liquid composition, comprising an amine oxide and/or such a short chain alkyl sulphate for providing improved shine to the surfaces being treated with this composition, this both when the composition is applied in its neat form or diluted form to the surface.

Optimum shine benefit is obtained at a weight ratio of the long chain alkyl sulphate to both the amine oxide and short chain alkyl sulphate of from 1/100 to 1/2 preferably from 112 to 1/30 and more preferably from 1/5 to 1/30. Lower ratios below 1/100 are not preferred herein as it may result in a surface showing spotty/streaky residues of the crystalline type.

Importantly, effective cleaning, disinfecting and shine benefits are obtained at low total levels of surfactants, preferably below 20% by weight of the total composition of the surfactant system comprising the amine oxide surfactant and the short and long chain alkyl sulphate surfactant, more preferably below 15% by weight, even more preferably from 0.01% to 10%. Indeed, at higher total level of surfactants, the compositions herein have the tendency to provide the disinfecting and cleaning benefit while still leaving greasy residues.

Additional Components

The composition of the invention may, optionally, contain preferred additional components such as solvents, peroxygen bleach, chelants, antimicrobial compounds or mixtures thereof.

Solvents

When used, solvents will, advantageously, give an enhanced cleaning and shine performance to the composition. Suitable solvents for incorporation in the compositions according to the present invention include all those known to those skilled in the art of hard-surfaces cleaner compositions. For example, suitable solvents for use herein include ethers and diethers having from 4 to 14 carbon atoms, preferably from 6 to 12 carbon atoms, and more preferably from 8 to 10 carbon atoms, glycols or alkoxylated glycols, glycol ethers and/or derivatives, polyols, alkoxylated aromatic alcohols, aromatic alcohols, aliphatic branched, or linear alcohols, alkoxylated aliphatic branched or linear alcohols, terpenes, and mixtures thereof.

Suitable glycols for use herein are according to the formula HO—CR1R2—OH wherein R1 and R2 are independently H or a C2–C12 saturated or unsaturated aliphatic hydrocarbon chain and/or cyclic. Suitable glycols to be used herein are dodecaneglycol, 1,2-hexanediol and/or propanediol.

Suitable alkoxylated glycols for use herein are according to the formula R—(A)n—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable glycol ethers and/or derivatives thereof for use herein include monoglycol ethers and/or derivatives thereof, di-, tri- and poly-glycol ethers and/or derivatives thereof and mixtures thereof.

Suitable monoglycol ethers and derivatives thereof for use herein include propylene glycol butyl ether, and water-soluble CELLOSOLVE® solvents or mixtures thereof. Preferred Cellosolve® solvents include 2-(Hexyloxy)ethanol (i.e., 2-hexyl Cellosolve®), ethylene glycol ethyl ether (i.e., 2-ethyl Cellosolve®), ethylene glycol butyl ether (i.e., 2-butyl Cellosolve®) or mixtures thereof.

Suitable polyglycol ethers and derivatives thereof for use herein include n-butoxypropoxypropanol (n-BPP), butyl triglycol ether (BTGE), butyl diglycol ether (BDGE), diethylene glycol butyl ether, water-soluble CARBITOL® solvents or mixtures thereof.

Preferred water-soluble CARBITOL® solvents are compounds of the 2-(2-alkoxyethoxy)ethanol class, 2-(2-alkoxyethoxy)propanol class and/or 2-(2-alkoxyethoxy) butanol class wherein the alkoxy group is derived from ethyl, propyl, butyl and tert-butyl. A preferred water-soluble carbitol is 2-(2-butoxyethoxy)ethanol also known as butyl carbitol®.

Suitable polyols for use herein are aliphatic linear or branched saturated or unsaturated hydrocarbons having from 2 to 12 carbon atoms, preferably 4 to 10, and comprising at least 2 hydroxyl groups, preferably from 2 to 4. Suitable polyols herein are diols such as 2-ethyl-1,3-hexanediol, 2,2,4-trimethyl-1,3-pentanediol, methyl-2,4 pentanediol, 1,6-hexanediol or mixture thereof.

Suitable alkoxylated aromatic alcohols for use herein are according to the formula $R(A)_n$—OH wherein R is an alkyl substituted or non-alkyl substituted awl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols for use herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic linear or branched alcohols for use herein are according to the formula R—OH wherein R is a branched or linear saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol. Particularly suitable aliphatic linear alcohols to be used herein include decanol, ethanol and/or propanol.

Suitable alkoxylated aliphatic linear or branched alcohols for use herein are according to the formula $R(A)_n$—OH wherein R is a branched or linear saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol. Suitable alkoxylated aliphatic linear alcohols include ethoxy propanol and/or propoxy propanol.

Other suitable solvents include ter amilic alcohol, terpene solvents and the like.

Suitable terpenes for use herein are mono-and bicyclic terpenes, especially those of the hydrocarbon class, which include the terpinenes, terpinolenes and pinenes and mixtures thereof. Highly preferred materials of this type are dipentene, alpha-pinene and/or betapinene. For example, pinene is commercially available from SCM Glidco (Jacksonville) under the name Alpha Pinene P&F®.

Particularly preferred solvents for use herein are ethylene glycol butyl ether, propylene glycol butyl ether, diethylene glycol butyl ether, butoxy propoxy propanol, butyl diglycol ether, benzyl alcohol, butoxypropanol, 2-(2-butoxyethoxy) ethanol, ethanol, methanol, benzyl alcohol, isopropanol and mixtures thereof.

Highly preferred solvent mixtures for use herein include:

- either 2-(2-butoxyethoxy) (preferably at level of 0.1% to 5% by weight), butoxy propanol (preferably at level of 0.1% to 10% by weight), and benzyl alcohol (preferably at level of 0.1% to 2% by weight),
- or ethanol (preferably at level of 0.1% to 10% by weight), butoxy propanol (preferably at level of 0.1% to 10% by weight) and benzyl alcohol (preferably at level of 0.1% to 2% by weight),
- or ethanol (preferably at level of 0.1% to 10% by weight) and butoxy propanol (preferably at level of 0.1% to 10% by weight)
- or ethanol alone. These solvent mixtures provide additional cleaning benefits in neat conditions and accelerate the evaporation time of the compositions comprising them, resulting in shorter cleaning time for the housewife.

Typically, the compositions of the present invention comprise up to 20% by weight of the total composition of a solvent or mixtures thereof, preferably from 0.5% to 10% by weight, more preferably from 1% to 8% and most preferably from 2% to 7% by weight of the composition.

Peroxygen Bleach

Another suitable additional component for use herein is a peroxygen bleach. Peroxygen bleach, especially hydrogen peroxide, persulfate and the like, in the compositions of the present invention advantageously contribute to the disinfection properties of said compositions. Hence, not to be bound by theory, it is believed that said peroxygen bleach may attack the vital function of the micro-organism cells, for example, it may inhibit the assembling of ribosomes units within the cytoplasm of the micro-organism cells. Also, said peroxygen bleach like hydrogen peroxide, is a strong oxidizer that generates hydroxyl free radicals which attack proteins and nucleic acids. Furthermore, the presence of said peroxygen bleach, especially hydrogen peroxide, provides strong stain removal benefits which are particularly noticeable for example in laundry and hard surfaces applications.

As used herein, a hydrogen peroxide source refers to any compound which produces hydrogen peroxide when said compound is in contact with water. Suitable water-soluble sources of hydrogen peroxide for use herein include percarbonates, persilicate, persulphate such as monopersulfate, perborates and peroxyacids such as diperoxydodecandioic acid (DPDA), magnesium perphthalic acid and mixtures thereof.

A preferred peroxygen bleach is hydrogen peroxide, or a water soluble source thereof, or mixtures thereof. A most preferred peroxygen bleach is hydrogen peroxide.

In addition to the peroxygen bleach, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, organic and inorganic peroxides.

Typically, the compositions herein may comprise at least 0.01% by weight of the total composition of said peroxygen bleach or mixtures thereof, preferably from 0.1% to 15%, more preferably from 0.8% to 10% and most preferably 1% to 5%.

Antimicrobial Compounds

Another suitable additional component for use herein is an antimicrobial compound or mixtures thereof.

Suitable antimicrobial compounds for use herein include antimicrobial essential oils, actives thereof and mixtures thereof. Suitable antimicrobial essential oils for use herein are those essential oils which exhibit antimicrobial activity. By "actives of essential oils", it is meant herein any ingredient of essential oils that exhibit antimicrobial activity. It is speculated that said antimicrobial essential oils and actives thereof act as proteins denaturing agents. Also said antimicrobial oils and actives thereof are compounds which contribute to the safety profile of a composition according to the present invention when used to disinfect any surface. A further advantage of said antimicrobial oils and actives thereof is that they impart pleasant odor to a composition comprising them without the need of adding a perfume.

Such essential oils include, but are not limited to, those obtained from thyme, lemongrass, citrus, lemons, oranges, anise, clove, aniseed, cinnamon, geranium, roses, mint, lavender, citronella, eucalyptus, peppermint, camphor, sandalwood and cedar and mixtures thereof.

Actives of essential oils for use herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid and/or geraniol.

Thymol may be commercially available for example from Aldrich, eugenol may be commercially available for example from Sigma, Systems—Bioindustries (SBI)—Manheimer Inc.

Typically, the antimicrobial essential oil or actives thereof or mixture thereof may be present in the composition herein at a level of at least 0.003% by weight of the total composition, preferably from 0.006% to 10%, more preferably from 0.01% to 4% and most preferably from 0.02% to 2%.

Other antimicrobial compounds may be used in the compositions of the present invention like glutalaldehyde and/or paraben including ethyl paraben, methyl paraben, propyl paraben or mixtures thereof up to a level of 5% by weight of the total composition.

In the embodiment of the present invention where the compositions herein comprise an antimicrobial compound, especially an antimicrobial essential oil or an active thereof or mixtures thereof, effective disinfection is obtained on a wide variety of microorganisms including Gram positive bacteria like *Staphylococcus aureus*, and Gram negative bacteria like *Pseudomonas aeroginosa* as well as on fungi like *Candida albicans* present on a surface, even if used in highly diluted conditions.

The following disinfecting test method may be applied to measure the disinfecting property of the composition:

Disinfecting Test Method

Disinfecting properties of a composition may be measured by the bactericidal activity of said composition. A test method to evaluate the bactericidal activity of a composition is described in European Standard, prEN 1040, CEN/TC 216 N 78, dated November 1995 issued by the European committee for standardisation, Brussels. European Standard, prEN 1040, CEN/TC 216 N 78, specifies a test method and requirements for the minimum bactericidal activity of a disinfecting composition. The test is passed if the bacterical colonies forming units (cfu) are reduced from a $10^7$ cfu (initial level) to a $10^2$ cfu (final level after contact with the disinfecting product), i.e. a $10^5$ reduction of the viability is necessary.

Other Optional Compounds

The compositions herein may further comprise a variety of other optional compounds including chelating agents, radical scavengers, builders, buffers, bactericides, enzymes, hydrotropes, colorants, stabilizers, bleach activators. soil suspenders, dye transfer agents, brighteners, perfumes, anti dusting agents, dispersant, dye transfer inhibitors, thickeners like polymeric thickeners, pigments, perfumes, dyes and mixtures thereof.

Chelating Agents

Chelating agents are also additional components which may be suitable for use herein.

Suitable chelating agents for use herein may be any chelating agent known to those skilled in the art such as the ones selected from the group comprising phosphonate chelating agents, amino carboxylate chelating agents or other carboxylate chelating agents, or polyfunctionally-substituted aromatic chelating agents or mixtures thereof. It has been found that the addition of a chelating agent to the compositions herein further participates to the disinfecting properties of the surfactants system herein.

Such phosphonate chelating agents may include etidronic acid (1-hydroxyethylidene-bisphosphonic acid or HEDP) as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium sets thereof or mixtures thereof. Ethylenediamine N,N'-disuccinic acids, especially the (S,S) isomer have been extensively described in U.S. Pat. No. 4,704,233, Nov. 3, 1987 to Hartman and Perkins. Ethylenediamine N,N'-disuccinic acid is, for instance, commercially available under the tradename ssEDDS® from Palmer Research Laboratories.

Suitable amino carboxylate chelating agents useful herein include ethylene diamine tetra acetate, diethylene triamine pentaacetate, diethylene triamine pentacetate (DTPA), N-hydroxyethylethylenediamine triacetate, nitrilotri-acetate, ethylenediamine tetraproprionate, triethylenetetraaminehexa-acetate, ethanoldiglycine, propylene diamine tetracetic acid (PDTA) and methyl glycine di-acetic acid (MGDA), both in their acid form, or in their alkali metal, ammonium, and substituted ammonium salt forms. Particularly suitable to be used herein are diethylene triamine penta acetic acid (DTPA), propylene diamine tetracetic acid (PDTA) which is, for instance, commercially available from BASF under the trade name Trilon FS® and methyl glycine di-acetic acid (MGDA).

Further carboxylate chelating agents for use herein includes malonic acid, salicylic acid, glycine, aspartic acid, glutamic acid, dipicolinic acid and derivatives thereof, or mixtures thereof.

Preferred chelating agents are those selected from the group of aminophosphonates. Preferred amino phosphonate chelants for use herein are diethylene triamine penta methylene phosphonate. Said chelating agents, especially phosphonate chelating agents like diethylene triamine penta methylene phosphonates, are particularly preferred in the compositions according to the present invention. In the preferred embodiments herein wherein the compositions of the present invention further comprise a peroxygen bleach like hydrogen peroxide and/or an antimicrobial compound like an essential oil or an active thereof, the chelanting agents have been found to further contribute to the disinfecting properties of the compositions herein. Indeed, such chelating agents contribute to improve the desinfecting properties of both hydrogen peroxide and the essential oil when present herein.

Typically, the compositions according to the present invention may comprise up to 5% by weight of the total composition of a chelating agent, or mixtures thereof, preferably from 0.002% to 3% by weight and more preferably from 0.002% to 1.5% by weight of the composition.

Radical Scavengers

Suitable radical scavengers for use herein include the well-known substituted mono and di-hydroxy benzenes and derivatives thereof, alkyl- and aryl carboxylates and mixtures thereof. Preferred radical scavengers for use herein include di-tert-butyl hydroxy toluene (BHT), p-hydroxytoluene, hydroquinone (HQ), di-tert-butyl hydroquinone (DTBHQ), mono-tert-butyl hydroquinone (MTBHQ), tert-butyl-hydroxy anysole, p-hydroxy-anysol, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxy-phenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2-methyl-4-hydroxy-5-t-butylphenyl)butane, tert-butyl-hydroxy-anyline, p-hydroxy anyline as well as n-propyl-gallate. Highly preferred for use herein is di-tert-butyl hydroxy toluene, which is for example commercially available from SHELL under the trade name IONOL CP®. These radical scavengers contribute to the stability of the compositions herein especially those further comprising a peroxygen bleach.

Typically, the radical scavenger, or a mixture thereof, is present in the compositions of the present invention up to a level of 5% by weight of the total composition, preferably from 0.002% to 3% by weight and more preferably from 0.002% to 1.5%.

Formulation Form of the Compositions

The compositions according to the present invention may be formulated either as solids or liquids. In the case where the compositions are formulated as solids, they will be mixed with an appropriate solvent, typically water, before use. In liquid form, the compositions are preferably but not necessarily formulated as aqueous compositions. Liquid compositions are preferred herein for convenience of use.

The liquid compositions herein, especially aqueous compositions according to the present invention have a pH as is of from 1 to 13, preferably from 2 to 10, and more preferably from 2 to 9. The pH can be adjusted by using alkalinising agents or acidifying agents. Examples of alkalinising agents are alkali metal hydroxides, such as potassium and/or sodium hydroxide, or alkali metal oxides such as sodium and/or potassium oxide. Examples of acidifying agents are organic or inorganic acids such as sulfuric acid.

Packaging Form of the Compositions

The compositions herein may be packaged in a variety of suitable detergent packaging known to those skilled in the art. The liquid compositions herein may desirably be packaged in manually operated spray dispensing containers, which are usually made of synthetic organic polymeric plastic materials. Accordingly, the present invention also encompasses liquid cleaning and disinfecting compositions of the invention packaged in a spray dispenser, preferably in a trigger spray dispenser. Indeed, said spray-type dispensers allow to uniformly apply to a relatively large area of a surface to be cleaned/disinfected the liquid compositions according to the present invention; thereby contributing to the cleaning and disinfecting properties of said compositions. Such spray-type dispensers are particularly suitable to clean/disinfect vertical surfaces.

Suitable spray-type dispensers for use according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

The compositions of the present invention may also be executed in the form of wipes. By "wipes", it is meant herein disposable towels, e.g., paper towels, incorporating a composition according to the present invention. Accordingly, the present invention also encompasses wipes, e.g. disposable paper towels, incorporating a liquid composition according to the present invention. In the preferred execution said wipes are impregnated, more preferably wetted with said liquid compositions. Preferably said wipes are packaged in a plastic box. The advantage of this execution is a faster usage of a cleaning/disinfecting composition by the user, this even outside the house, i.e. there is no need to pour the liquid compositions according to the present invention on the surfaces to be treated and to dry it out with a cloth. In other words, wipes allow cleaning and disinfecting of surfaces in one step.

The present invention encompasses a process for treating surfaces wherein a composition according to the present invention is applied onto said surfaces.

By "surface" it includes any hard-surface typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as any household appliance including, but not limited to, refrigerators, freezers, washing machines, automatic dryers, ovens, microwave ovens, dishwashers and so on.

In the process of treating surfaces according to the present invention said compositions may be applied to the surface to be treated in its neat form or in its diluted form.

By "treating", it is meant herein cleaning as well as disinfecting as the compositions herein comprise surfactants having both properties.

By "diluted form", it is meant herein that the compositions to be used in the process herein being either in a liquid or solid form may be diluted by the user typically up to 500 times their weight of water, preferably up to 300 times, more preferably up to 200 times, even more preferably into 80 to 30 times their weight of water, and most preferably 60 to 40 times.

In a preferred embodiment of the process of the present invention wherein said composition is applied to a surface to be treated, such as a hard-surface, in its diluted form, it is not necessary to rinse the surface after the composition has been applied; indeed, no visible residues are left onto the surface.

The following test methods applied to measure the cleaning and shine benefit are as follows:

Cleaning Test Method

Standard enamel plates were soiled by applying on them a grease/particulate matter and then baking them. The tested compositions were then applied on a sponge and then placed onto a Gardner Machine. The Gardner machine measured the number of strokes needed to reach 95–99% clean plates. The performance was measured as such (i.e. undiluted) and upon dilution at 1.5% in water.

Shine Test Method

Five millimetres of test product are applied to one face of a wetted sponge. The wetted sponge is applied in one motion with even pressure from top to bottom of a previously cleaned, with isopropyl alcohol, black tile. The tile with the applied product(s) is allowed to dry for ten minutes before grading by expert judges. The control reference is made by repeating the above test with a wetted sponge but without the tested product.

Expert judges are employed to evaluate the specific area of product application for amount of filming/streaking. A numerical value describing the amount of filming/streaking is assigned to each product. For the test results, a 0–4 scale is used 0=There is no difference between the tested product and the control reference, i.e. poor filming/streaking performance of the tested product.

4=There is a clear difference between the product and the control reference, i.e. no filming/streaking with the tested product.

The invention is illustrated in the following non limiting examples, in which all percentages are on a weight basis unless otherwise stated.

In the examples, the abbreviated component identifications have the following meanings:

| | |
|---|---|
| amine oxide | N-decyldimethyl amine oxide |
| C8AS | C8 alkyl sulphate |
| C10AS | C10 alkyl sulphate |
| C7–8AS | C7–C8 alkyl sulphate |
| Synperonic 91:5 ® | C9–11 penta ethoxylated alcohol |
| HEDP | 1-hydroxyethylidene-bisphosphonic acid |
| butyl carbitol ® | 2-(2-butoxyethoxy)ethanol |

EXAMPLES

The following compositions, according to the present invention, were made by mixing the listed ingredients in the listed proportions (% by weight):

| Compositions | A | B | C | D | E | F |
|---|---|---|---|---|---|---|
| Amine oxide | 1 | 0.9 | 0.9 | 0.9 | 1 | 1 |
| C8AS | — | 4.5 | 4.5 | 4.5 | 4.5 | 4.5 |
| C10AS | 0.7 | 1.0 | 0.5 | 0.7 | 1.0 | 1.0 |
| C7–8AS | 4.5 | — | — | — | — | — |
| Ethanol | 2.5 | 2.5 | 2.5 | 2.5 | 2.5 | 2.5 |
| HEDP | 0.09 | 0.09 | 0.09 | 0.09 | — | 0.09 |
| Benzyl alcohol | — | 0.8 | 0.8 | 0.8 | 0.8 | 0.8 |
| Synperonic 91:5 ® | — | — | — | 1 | — | — |
| Thymol | 0.1 | 0.1 | 0.05 | 0.1 | 0.1 | — |
| Hydrogen peroxide | 1.5 | 1.5 | 1.5 | 1.5 | — | 1.5 |
| pH | 3 | 4 | 3 | 8 | 2 | 9 |
| | Water and minors up to 100% | | | | | |

| Compositions | G | H | I | J | K | L |
|---|---|---|---|---|---|---|
| Amine oxide | 1 | 1 | 0.9 | 0.9 | 0.9 | 1 |
| C8AS | 4.5 | | 4.5 | 4.5 | 4.5 | 4.5 |
| C10AS | 0.7 | 0.7 | 1.0 | 0.5 | 0.7 | 1.0 |
| C7–8AS | | 4.5 | — | — | — | — |
| HEDP | — | — | 0.09 | — | — | — |
| Thymol | — | — | — | 0.1 | 0.1 | 0.2 |
| Hydrogen peroxide | — | — | 1.5 | — | 1.5 | 1.5 |
| pH | 3 | 3 | 4 | 3 | 8 | 5 |
| | Water and minors up to 100% | | | | | |

The above compositions deliver effective cleaning and disinfecting performance to the surface treated therewith both in neat and diluted conditions while providing the treated surface with a shiny effect.

What is claimed is:

1. A cleaning and disinfecting composition comprising:

a) a surfactant system comprising i) from about 0.01% to about 10% by weight of the total composition of an amine oxide;

ii) from about 0.01% to about 20% by weight of the total composition of a short chain alkyl sulfate surfactant according to the formula R1SO4M wherein R1 represents a saturated or unsaturated alkyl group containing from about 6 to about 7 carbon atoms and M is H or a cation;

iii) from about 0.01% to about 20% by weight of the total composition of a long chain alkyl sulfate surfactant according to the formula R2SO4M wherein R2 represents a saturated or unsaturated alkyl group containing from about 9 to about 30 carbon atoms and M is H or a cation;

b) an antimicrobial essential oil compound or mixture thereof; and c) from about 0% to about 20% by weight of the total composition of a solvent; wherein said amine oxide correspond to the formula R R'R"N→O wherein R is a primary alkyl group containing 6–24 carbons, R' and R" are each independently selected from methyl, ethyl and 2-hydroxyethyl; and wherein the primary alkyl group of said amine oxide has a straight chain in at least 70% of the molecules; and wherein said solvent is selected from the group consisting of glycol or alkoxylated glycol, glycol ether or derivative, polyol, alkoxylated aromatic alcohol, aromatic alcohol, aliphatic branched or linear alcohol, alkoxylated aliphatic branched or linear alcohol, terpenes, and mixtures thereof.

2. A composition according to claim 1, wherein said amine oxide is according to the formula: R R'R"N→O wherein R is a primary alkyl group containing 6–24 carbons, preferably 8–18 carbons, and wherein R' and R" are, each, independently selected from methyl, ethyl and 2-hydroxyethyl.

3. A composition according to claim 1, wherein said amine oxide or mixture thereof, is present at a level of about 0.1% to about 9% by weight of the total composition.

4. A composition according to claim 3, wherein said amine oxide or mixture thereof, is present at a level of about 0.5% to about 5% by weight of the total composition.

5. A composition according to claim 3, wherein said amine oxide or mixture thereof, is present at a level of about 0.5% to about 3% by weight of the total composition.

6. A composition according to claim 1, wherein in said long chain alkyl sulfate, $R_2$ represents a saturated or unsaturated alkyl group containing,from about 9 to about 18 carbon atoms.

7. A composition according to claim 1, wherein said short chain alkyl sulfate is octyl sulphate.

8. A composition according to claim 1, wherein the weight ratio of the long chain alkyl sulphate to both the amine oxide and short chain alkyl sulphate is of from about 1/100 to about 1/2.

9. A composition according to claim 8, wherein the weight ratio of the long chain alkyl sulphate to both the amine oxide and short chain alkyl sulphate is of from about 1/2 to about 1/30.

10. A composition according to claim 8, wherein the weight ratio of the long chain alkyl sulphate to both the amine oxide and short chain alkyl sulphate is of from about 1/5 to about 1/30.

11. A composition according to claim 1, wherein said composition comprises a solvent at a level from about 0.5% to about 10% by weight of the total composition.

12. A composition according to claim 11 wherein said composition comprises a solvent at a level from about 1% to about 8% by weight of the total composition.

13. A composition according to claim 1, wherein said solvent is selected from the group consisting of ethylene glycol butyl ether, propylene glycol butyl ether, diethylene glycol butyl ether, butoxy propoxy propanol, butyl diglycol ether, 2-(2-butoxyethoxy)ethanol, butoxypropanol, ethanol, methanol, benzyl alcohol, isopropanol, and mixtures thereof.

14. A composition according to claim 1, wherein said antimicrobial essential oil compound selected from the group consisting of thyme oil, lemongrass oil, citrus oil, lemon oil, orange oil, anise oil, clove oil, aniseed oil, cinnamon oil, geranium oil, rose oil, lavender oil, citronella oil, eucalyptus oil, peppermint oil, mint oil, camphor oil, sandalwood oil, cedar oil, rosmarin oil, pine oil, vervain oil, fleagrass oil, ratanhiae oil and mixtures thereof, and/or active of essential oil selected from the group consisting of thymol, eugenol, menthol, carvacrol, verbenone, eucalyptol, cedrol, anethol, pinocarvone, geraniol, hiokitiol, berberine, ferulic acid, cinnamic acid, methyl salycillic acid, methyl salycilate, terpineol and mixtures thereof.

15. A composition according to claim 14 wherein said antimicrobial essential oil compound is present at a level of at least 0.003% by weight of the total composition.

16. A composition according to claim 14 wherein said antimicrobial essential oil compound is present at a level of from about 0.006% to about 10% by weight of the total composition.

17. A composition according to claim 14 wherein said antimicrobial essential oil compound is present at a level of from about 0.01% to about 10% by weight of the total composition.

18. A composition according to claim 14 said antimicrobial essential oil compound is present at a level of from about 0.02% to about 2% by weight of the total composition.

19. A composition according to claim 1 wherein said composition further comprises a peroxygen bleach or a mixture thereof at a level of at least 0.01% by weight of the total composition.

20. A composition according to claim 19 wherein said composition comprises a peroxygen bleach or a mixture thereof, at a level of from about 0.1% to about 15% by weight of the total composition.

21. A composition according to claim 19 wherein said composition comprises a peroxygen bleach or a mixture thereof, at a level of from about 0.8% to about 10% by weight of the total composition.

22. A wipe incorporating a composition according to claim 1.

23. A composition according to claim 1, wherein said composition is liquid and is packaged in a spray dispenser.

24. A process for treating a hard-surface, by applying on said surface a composition as defined in claim 1.

25. A process for treating a surface according to claim 24, wherein said composition is diluted up to 500 times its weight of water before it is applied to said surface.

26. A process according to claim 25, wherein said surface is not rinsed after said composition has been applied.

27. A method of improving shine to a surface being treated by applying on said surface a liquid composition according to claim 1.

28. A composition according to claim 6, wherein in said long chain alkyl sulfate, $R_2$ represents a saturated or unsaturated alkyl group containing from about 9 to about 14 carbon atoms.

29. A composition according to claim 19 wherein said peroxygen bleach is hydrogen peroxide at a level of at least 0.01% by weight of the total composition.

30. A composition according to claim 23, wherein said composition is liquid and is packaged in a trigger pray dispenser.

31. A process according to claim 25 wherein said composition is diluted up to about 300 times before it is applied to said surface.

32. A process according to claim 25 wherein said composition is diluted about 80 to about 40 times its weight of water before it is applied to said surface.

33. A process according to claim 25 wherein said composition is diluted about 60 to about 30 times before it is applied to said surface.

34. A composition according to claim 13, wherein said solvent is selected from the group consisting of 2-(2-butoxyethoxy), butoxy propanol, benzyl alcohol, ethanol, and mixtures thereof.

* * * * *